United States Patent [19]

Oskam

[11] Patent Number: 4,648,436

[45] Date of Patent: Mar. 10, 1987

[54] VERTICAL LOUVRE BLIND AND PARTS THEREFOR

[75] Inventor: Herman Oskam, Bergambacht, Netherlands

[73] Assignee: Hunter Douglas International N.V., Curacao, Netherlands

[21] Appl. No.: 580,681

[22] Filed: Feb. 16, 1984

[30] Foreign Application Priority Data

Mar. 24, 1983 [GB] United Kingdom ..... 8308061

[51] Int. Cl.[4] ..... E06B 9/30

[52] U.S. Cl. ..... 160/168 R; 160/177; 160/166 A; 160/178 R

[58] Field of Search ..... 160/178 R, 168 R, 166 A, 160/166 R, 174, 177

[56] References Cited

U.S. PATENT DOCUMENTS

| | | | |
|---|---|---|---|
| 3,500,896 | 3/1970 | Hidehiro Endou | 160/168 R |
| 3,996,988 | 12/1976 | de Wit | 160/168 R |
| 4,006,769 | 2/1977 | Woodle | 160/166 A |
| 4,103,727 | 8/1978 | Spuhr | 160/168 R |
| 4,122,884 | 10/1978 | Salzmann | 160/168 R |
| 4,332,288 | 6/1982 | Frentzel et al. | 160/168 R |
| 4,356,855 | 11/1982 | Holzer | 160/178 R |
| 4,381,811 | 5/1983 | Frentzel et al. | 160/178 R |

FOREIGN PATENT DOCUMENTS

| | | | |
|---|---|---|---|
| 7804423 | 10/1979 | Netherlands | 160/166 A |

*Primary Examiner*—Ramon S. Britts
*Assistant Examiner*—David M. Purol
*Attorney, Agent, or Firm*—Pennie & Edmonds

[57] ABSTRACT

A vertical louvre blind has several identical travellers (16), an end one of which is moved by a pull cord (100), inserted between two fingers (90). This traveller pulls the other travellers by means of a ball chain (98) inserted between the fingers and into a slot (96). A tilt rod (14) rotates a worm (18) in each traveller, the worm engaging a wormwheel which can readily be pushed into the housing of the traveller. The wormwheel carries a hook (80) on which is mounted a louvre hanger. The louvre hangers each consist of two bars (30) and (34), the louvre material (22) being folded over to form a hem which can be clamped between the two bars by moving them transverse to their length. It is possible with the blind to have an easy modification of a stock blind to fit windows of several sizes.

10 Claims, 10 Drawing Figures

VERTICAL LOUVRE BLIND AND PARTS THEREFOR

The present invention relates to vertical louvre blinds and to parts therefor.

Vertical louvre blinds usually comprise a headrail with several travellers movable along the headrail by one means or another, each traveller carrying a hanger from which is suspended a vertical louvre. The traveller is capable not only of moving longitudinally along the headrail but also of imparting a rotary or tilting motion to the louvre, the arrangement being such that all of the louvres are operated simultaneously so that they always extend substantially parallel to one another. Provision is often made to allow the blinds to move slightly if they are inadvertently hit and for them to spring back. It is customary for these louvre blinds to be made specially for the particular window for which they are intended and this can be rather costly.

It is one object of the present invention to provide a blind, and parts therefor, which can be of a stock size to suit several different window sizes and which can be adjusted to the requirement of the particular window by the user.

According to the present invention, there is provided a hanger arrangement for a louvre of a vertical louvre blind comprising first and second elongate holding bars, complementary surfaces on said bars, a central element on at least one of the bars enabling it to be hung from a support, interengaging means on said first and second bars, adapted when in abutting relation to secure said bars in overlying face-to-face relationship, the interengaging means being operable to secure said bars upon relative movement of said bars to said overlying position, said movement being substantially in two parallel planes and in a direction transverse to the length of the bars, whereby louvre material can be fixedly held between the confronting complementary surfaces.

Such a construction can be made relatively inexpensively and readily enables the user to adjust the length of the louvre to suit his own window. The amount of material which is folded over can readily be changed to suit the requirement of a particular window and by using the hanger arrangement of the invention it is possible for the user to provide the accurate adjustment in a very simple manner. Preferably at least one of the bars has at its lower edge a longitudinally extending continuous or discontinuous rib which projects from the surface thereof facing the other bar, the mutual distance between the bars being sufficient to accommodate the end of the louvre material folded over upon itself and the space between the rib and the other bar being sufficient to accommodate a single thickness of louvre material. This ensures a firm clamping of the top end of the louvre material. The engaging means may comprise a lug on one end of one of the bars, which is inturned to extend back towards the opposite end and substantially parallel to the bar, and a recess to accommodate a lug on a corresponding end portion of the other bar sprung back into it and an identical or reverse arrangement at the other ends of the bars.

In order to ensure that the two bars do not become disconnected they are advantageously provided with locking means to retain them in overlying relation with the interengaging means in their operable condition. These locking means may comprise part of said central element on one of the bars and at least one hook-like clip on the other bar, which can be sprung over an upstanding tab portion on the central element when the bars are in fully overlying relationship.

According to another aspect of the present invention, there is provided a traveller for handling the louvre of a vertical louvre blind, said traveller comprising a housing, means to support and guide the housing within the blind headrail, a worm rotatable about a horizontal axis by a tilt rod passing longitudinally through the headrail, a lower wall to the housing below the worm, a slot extending from one end of the lower wall in a direction transverse to the axial direction of the headrail, a wormwheel having a bearing slidable into said slot to a position in which it is in operable engagement with the worm, and means to retain the wormwheel in this position.

Such a traveller is relatively inexpensive to manufacture and yet is effective in operation. The housing preferably includes two side walls extending upwardly from the lower wall and having an opening therein to accommodate a portion of the periphery of the wormwheel in its operable position, the side walls being spaced by a distance less than the diameter of the wormwheel and being capable of flexing away to allow the wormwheel to slide into the slot and to spring back when the wormwheel is in said operable position to retain it in place.

The invention also provides a traveller for holding the louvre of a vertical louvre blind, said traveller comprising a housing, means to guide and support said housing with respect to the blind headrail, a worm rotatable about a horizontal axis so as to be driven by a tilt rod extending longitudinally within the blind headrail, and a wormwheel rotatable about a vertical axis in operable engagement with said worm, wherein the body of the wormwheel has a vertical bore therein, said body comprising an upper and a lower abutment surface and further comprising a louvre hook having a shaft insertable into the bore, the shaft having a head thereon, engageable with the upper abutment surface, said head being resiliently deformable to allow the shaft insertion and its own engagement with the upper adjustment surface and one or more arms engageable with the lower abutment surface of the wormwheel, to urge the hook downwardly and the head against the upper abutment surface.

Such an arrangement is very inexpensive to manufacture and easy to assemble. Preferably, the head includes a lower ridge and the abutment includes a radially extending groove in which the lower ridge is engageable to give a preferred orientation of the hook relative to the wormwheel, the hook being able to rise against the resilient action of the arm(s), and the ridge and groove being dimensioned to allow relative rotation of the hook and the wormwheel in an overload condition.

Such a construction enables the louvre to take up a preferred orientation but also enables it to be knocked without damage to the traveller or the louvre. If the louvre is knocked then it can simply be subsequently returned to the preferred orientation position.

The housing advantageously includes a front wall and wherein a pair of forwardly and upwardly extending fingers project from said front wall to define a channel thereabove and a first slot therebetween which is open at each end, the lower or rear end of the slot continuing into a second and a third slot oppositely directed and each angled with respect to the first slot and having a restricted end portion, the arrangement being such that (a) a pull cord for translating an end traveller can pass along and be guided by the channel; (b) the pull cord can be deflected through the first slot of a traveller and tied into a knot and blocked by the slot to enable the pull cord to effect translation of the traveller, when functioning as an end traveller; (c) a flexible traveller interconnecting means having at least one thicker part can be passed through the first slot into the second or third slot, the thicker part thereby engaging from within the inner side of the slot against one of the restrictions to enable the traveller to be connected to a neighbouring traveller by the flexible interconnecting means.

It will be appreciated that such a construction enables the traveller to be of a "universal" type, so that all the travellers in the headrail can be the same. By using connecting means, having at least one thickened part, for example a ball chain, the actual spacing between the travellers can be adjusted accurately to the desired spacing for a particular window.

In a vertical louvre venetian blind, when the louvres are pulled to the open condition, the travellers are then no longer in a position to support the tilt rod along the full length. It has been proposed to provide a tilt rod support which is movable along the blind and such a construction is illustrated, for example, in U.S. Pat. No. 4,293,021. The support is moved by a pull cord which is used to translate the travellers and the pull cord is lightly clamped by an element referred to as "friction means" in that Patent. Such a construction is not entirely satisfactory because the friction can readily vary from one such device to another.

It is now proposed, according to the present invention, to provide a travelling tilt rod support for a vertical louvre blind, said tilt rod support comprising a body, means to support and guide the body within the blind headrail, said body comprising a surface for supporting a tilt rod and two resilient members projecting in opposite directions and overlapping with their free ends, said members at their overlap having a mutual distance smaller than the diameter of a pull cord, frictionally clamping said pull cord during translation of the support and slidingly guiding said pull cord upon arresting of the support by engagement with a stop in the headrail.

Because the two resilient members overlap and have their free ends pointing in opposite directions, the mutual distance betweent the two members is substantially constant and it is of little consequence at what actual location between these two members the pull cord passes.

Furthermore, in some blinds the pull cord is passed over a pulley, and is therefore higher at one end of the blind than at the other. This will have no effect on the frictional force applied to the support and the length of the overlap is preferably at least three times the diameter of the pull cord.

In order that the invention may more readily be understood, the following description is given, merely by way of example, reference being made to the accompanying drawings, in which.

Figure 1:
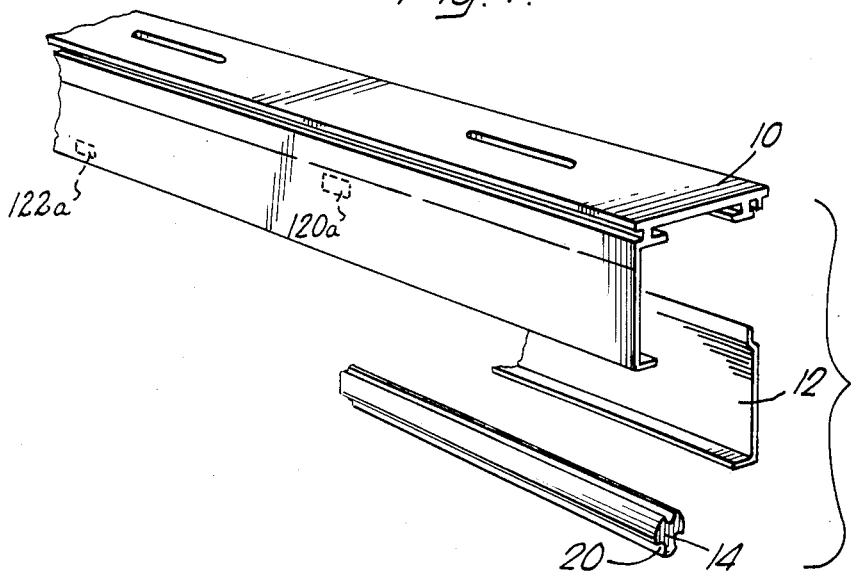
FIG. 1 is an exploded view of one embodiment of the vertical blind headrail.
Figure 5:
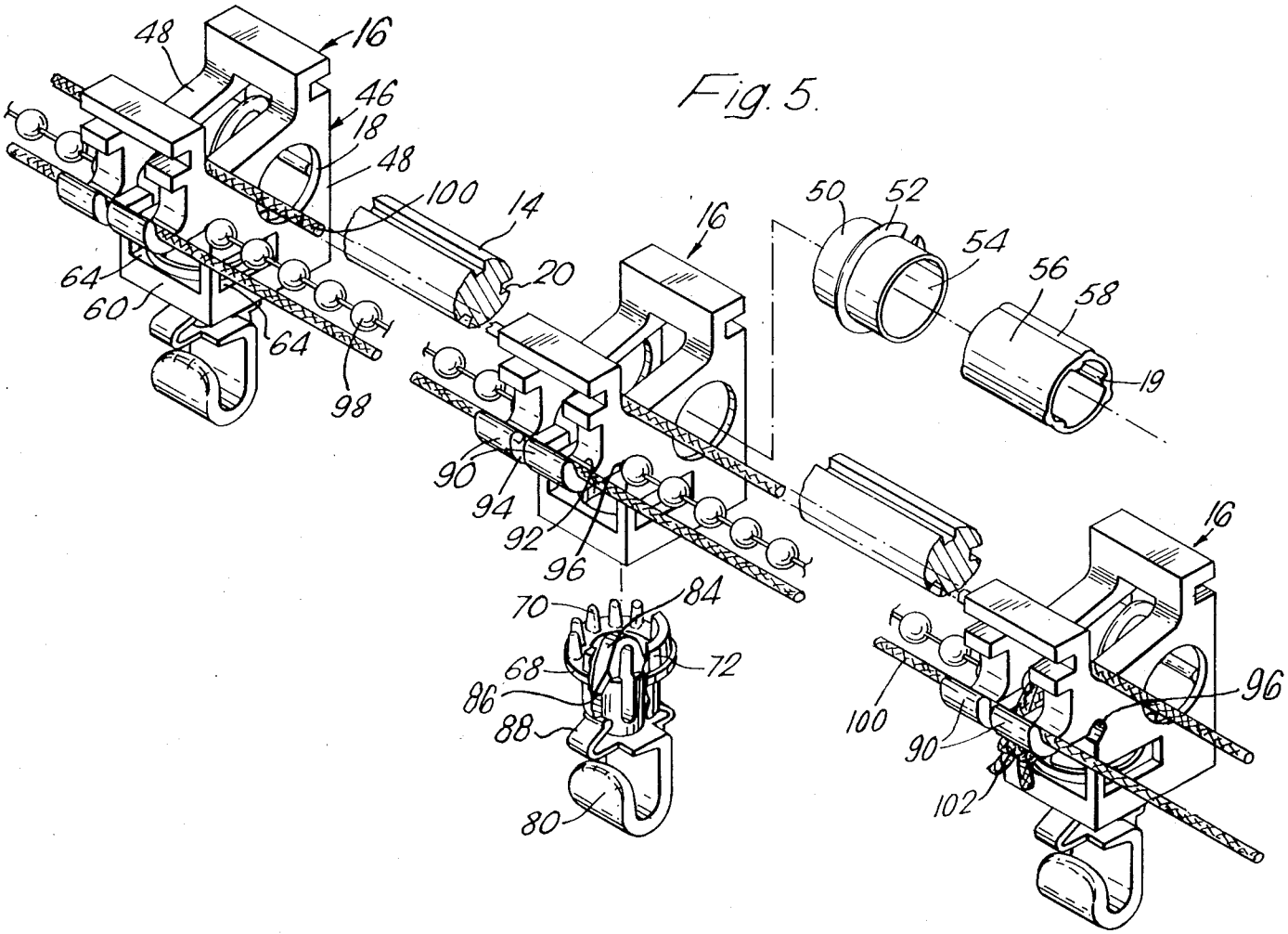
FIG. 5 is a perspective view showing one of the travellers exploded to illustrated the component parts and an adjacent pair of travellers assembled.

Referring first to FIG. 1, there is illustrated a headrail 10 of inverted channel form. The rear wall 12 is shown as being capable of being removed although this is not essential. Extending longitudinally within the headrail is a tilt rod 14 and longitudinally movable within the headrail are several travellers 16 as shown in FIG. 5 which include, as will be explained later, worms 18 which are slidable relative to the tilt rod 14, the latter being provided with longitudinally extending grooves 20 which enable the travellers to move along the headrail and at the same time enable the tilt rod to rotate the worms.

Figure 2:
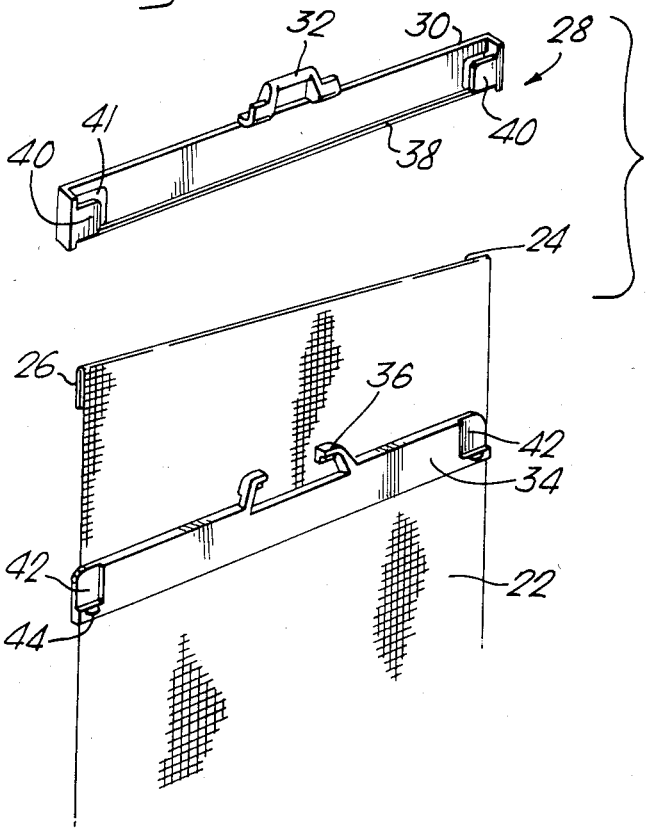
FIG. 2 is an enlarged perspective view of the upper end of one of the louvres illustrating the assembly of the louvre hanger arrangement.
Figure 3:
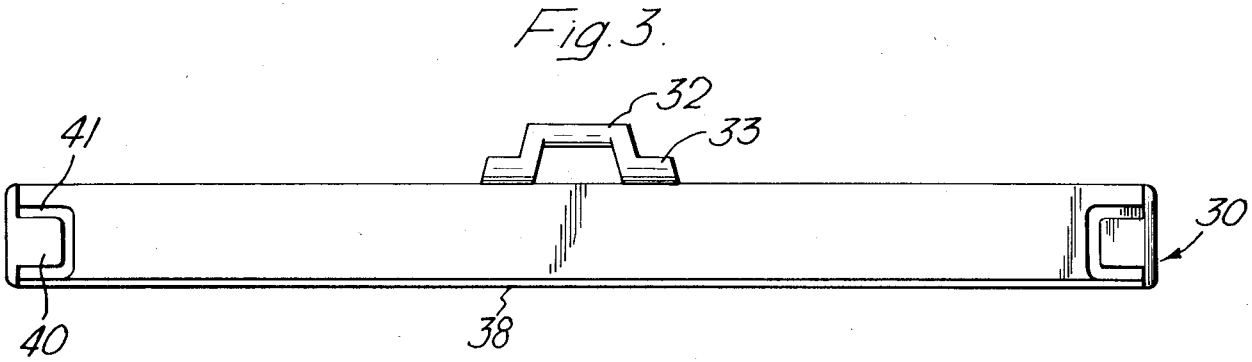
FIGS. 3 and 4 are front elevations of the first and second holding bars of the hanger arrangement of FIG. 1.
Figure 4:
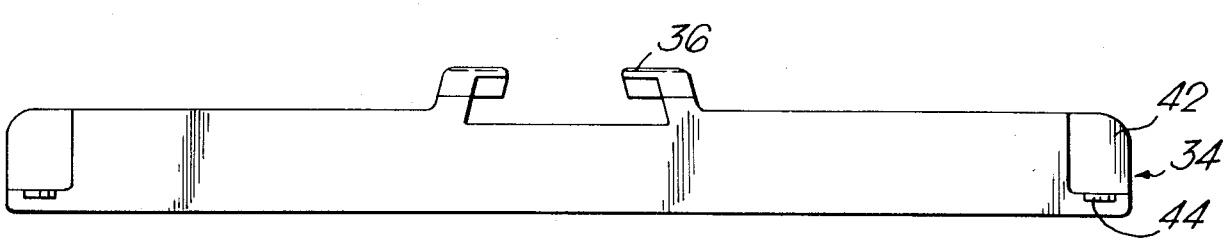

Suspended from each of the travellers is a louvre 22, as shown in FIG. 2. The means of suspension is illustrated more clearly in FIGS. 2 to 4. The louvre 22 itself is formed of a fabric, or a plasticised fabric, and is folded over at its upper end 24 to form a hem 26. A hanger arrangement 28 includes a first holding bar 30 provided with a central bridge 32 enabling the hanger arrangement and the louvre thereon to be mounted on the traveller, as will be explained later. An upstanding tab 33 is provided at each end of the bridge. The hanger arrangement also includes a second clamping bar having a central clip 36 positioned at the same location as the bridge of the first holding bar. It will be seen that the first holding bar includes a longitudinally extending rib 38, and, adjacent each end, an inturned lug 40 which extends back towards the opposite end and substantially parallel to the bar. Behind each lug 40 is an aperture 41.

The second holding bar includes, adjacent each end, a small recess 42 and immediately below the recess is a ledge 44.

In order to mount the louvre, one simply forms the hem 26 as indicated, and inserts the hem behind the lugs 40 and then one slides the second bar 34 in a direction transverse to its length, so that the recess 42 engages behind the lug 40 until the lug 40 abuts the ledge 44. The edges of the clip 36 are then bent up, the bar flexing a little to allow this, and engaged over the tabs 33 on each side of the bridge 32 to hold the two holding bars together. The folded over hem will be fixedly held between the two bars 30 and 34 very firmly and it is very simple for the user to modify the slat to suit any minor variation in the window length. A similar arrangement (not shown) can be provided at the bottom of the louvre together with suitable weights to tension the louvre.

Figure 6:
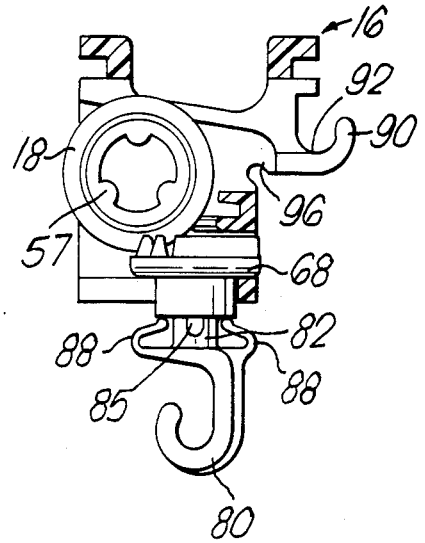
FIG. 6 is a side elevation, partly in section, and to a very much enlarged scale, of one of the travellers.

Referring now to FIG. 5 there are illustrated therein three of the travellers 16. The righthandmost of these travellers is the end traveller of the blind and it is this traveller which is used to move all of the other travellers longitudinally of the headrail. The travellers each include a housing 46 including spaced side walls 48 in which is rotatably mounted the worm 18. This worm in fact includes an outer sleeve 50 having an outwardly projecting worm thread 52 and an inner surface 54. Slid into the sleeve 50 is a inner sleeve 56 having an end wall 57 (FIG. 6) suitably apertured to receive the tilt rod 14 and provided with outward projections 58 which can engage the inner surface 54 to act as an overload friction clutch. Inner projections 19 on the inner surface of the inner sleeve 56 engage in grooves 20 of tilt rod 14. The housing 46 of the traveller also includes a front wall 60 and a lower wall 62. The side and front walls each have openings 64 therein and the lower wall has a slot 66 which extends from the rear edge thereof forwardly. Because of the configuration of the traveller, the side walls can be pulled apart slightly at the rear and this is useful in assembling the traveller. The worm 18 cooperates with a wormwheel 68 which has, on its upper surface, teeth 70 extending around a 180 degree arc and a ridge 72 extending around the remaining 180 degrees. This arrangement ensures that the wormwheel in fact is only caused to rotate by 180 degrees and any further rotation of the tilt rod will simply cause slippage of the clutch arrangement provided by the sleeves 50, 56.

Figure 7:
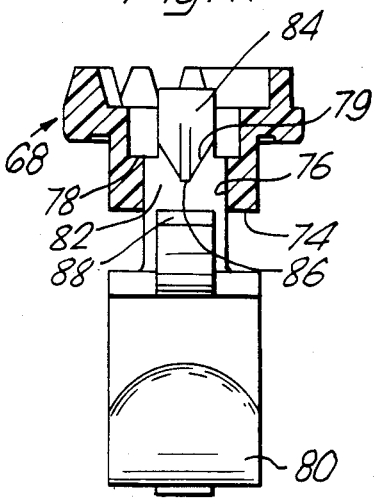
FIG. 7 is a front elevation of the wormwheel and louvre hook of FIG. 6.

As can be seen from FIG. 7 the wormwheel includes a lower abutment surface 74 and a bore 76 which has an upper abutment 78 spaced from its lower end. The upper abutment surface is provided with a radially extending groove 79. The louvre hook 80 is provided with a shaft 82 having a head 84 thereon, the head projecting laterally beyond the shaft and having a lower ridge 86 so that, when the hook shaft 82 is pushed up through the bore 76, the bore moves resiliently inwardly a little, into the slots 85 in shaft 82, and springs back after the head has gone beyond the abutment and then the ridge 86 and the radial groove 79 give the wormwheel and the hook a preferred relative orientation. The upper surface of the hook is provided with two arms 88 which bear against the lower surface 74 of the wormwheel to urge the ridge into engagement with the groove. In an overload condition, the hook can move upwardly relative to the wormwheel and the ridge can move out of the groove to allow further rotation, this being accommodated by the resilience of the arms 88.

Figure 8:
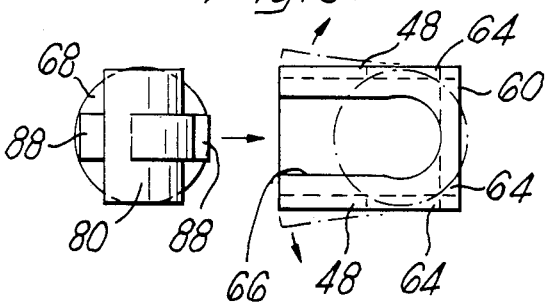
FIG. 8 is an underneath plan schematically illustrating the insertion of the wormwheel of the traveller of FIG. 6.
Figure 9:
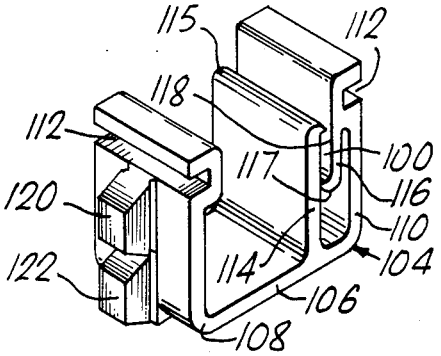
FIG. 9 is a perspective view of one of the tilt rod supports.
Figure 10:
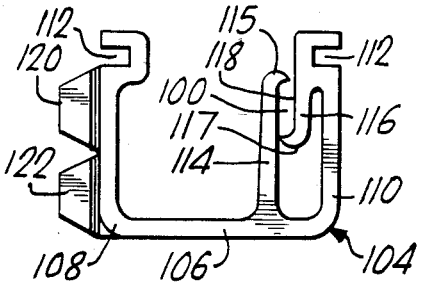
FIG. 10 is an enlarged end view of the support of FIG. 9.

In order to insert the wormwheel into the housing the wormwheel is pushed into the open end of the slot 66 and the side walls 48 move outwardly as shown in FIG. 8. Once the wormwheel has arrived at a position beyond the worm the edges of the wormwheel will pass into the openings 64 and the housing side walls 48 will spring back so as to be parallel with one another and will thus retain the wormwheel in position in engagement with the worm 18.

The front wall 60 is provided with two forwardly and upwardly extending fingers 90 which define a channel 92 on the upper surface and a first slot 94 between the fingers. This slot 94 is open at its upper and lower ends and at its lower end it communicates with the centre of a second slot 96 in the front wall which extends tranverse to the first slot. The width of the slot 94 is sufficient to allow the passage of the reduced cross-section portion between the balls of a ball chain 98 and the ends of the further slot 96 are of approximately the same size thus to retain the ball chain against movement. The ball chain is introduced by inserting it into the top of the slot 94, pulling downwardly and then to one side or the other. The second slot 96 is shown as a single slot extending in opposite directions which are aligned. It could be two slots which are not aligned, but are each connected to slot 94.

A pull cord 100 is passed through the channel 92 of each traveller and round a pulley (not shown) at the end of the headrail to pass back through the upper surface of the travellers. The righthandmost traveller shown in FIG. 5 is the one designed to move the other travellers and the cord 100 is passed between the fingers 90 and a knot 102 is tied in the cord. Adjacent travellers are interconnected by suitable lengths of the ball chain 98. Operation of the pull cord in one direction, that is so that the front portion is moved to the right in FIG. 5, will cause the righthandmost traveller to move to the right and as soon as the ball chain 98 connecting it to its neighbouring traveller is taut it will pull the next traveller along and so on. Thus the ball chain is a very simple way of spacing the travellers along the headrail. When the cord is operated in a reverse direction the end traveller will be pulled back to the left and will abut its neighbouring traveller and push it along and so on.

When the blind is fully open, that is with all the travellers against one another, the tilt rod will be unsupported over a substantial portion of its length. To overcome this problem the headrail is provided with two sliding tilt rod supports 104. Each of these is of generally U-shaped configuration, the web 106 of the U being provided with a first arm 108 and a second arm 110, these arms each being provided with grooves 112 adjacent their upper end for engagement in a ridge in the headrail. Adjacent the second arm 110 is an upstanding wall member 114 having a projection 115 extending towards the wall 110 at its upper end. Projecting downwardly from the upper end of the wall 110 is a further wall 116 having a projection 117 at its lower end. The two walls and projections, therefore, provide a resilient groove 118 through which the pull cord 100 can pass and be clamped. Irrespective of the position of the pull cord 100 in the sliding holder 118 the clamping force on the sides of the pull cord will be substantially identical. The outer surface of the wall 108 is provided with two outwardly projecting elements 120, 122.

In use of the supports 104, these are mounted on the "uncovered" portion of the headrail beyond the end traveller 16. When the blind is drawn to the fully closed position the supports 104 are simply pushed by the end traveller to the far end of the headrail. When the blind is pulled back, however, the pull cord 100 will pull with it the two supports 104. One of the supports 104 has the element 120 remaining and the element 122 broken off and the other support has the element 120 broken off and the element 122 remaining. The headrail is provided with two spaced stops **120*a*, 122*a*; a first one of its supports will simply pass one of these stops because its element has been broken off and it will then hit the other stop in the headrail to arrest movement of the support, while the other support will have been previously arrested by the first stop. The grip of the two walls 114, 116 is sufficient to allow movement of the supports, but is small enough to allow the pull cord to continue to slide therethrough after the supports 104** have been arrested.

It will be seen that the structure of the present invention is well adapted to be adjusted to the requirements of a particular window. The louvre length can be easily changed using the hanger arrangement. The number of travellers can be varied, the user simply discarding unwanted travellers. Since the travellers are all the same, any one of them can be used as an end traveller. The spacing between individual slats can easily be adjusted using the ball chains as described. Furthermore, all the parts of the hanger arrangement of the travellers and of the tilt rod supports can be manufactured relatively inexpensively and to a standard design and can be assembled easily.

I claim:

1. A traveller for holding a louvre of a vertical louvre blind headrail, said traveller comprising a housing, means to support and guide the housing within the blind headrail, a worm rotatably mounted in said headrail for rotation about a horizontal axis by a tilt rod passing longitudinally through the headrail, a lower wall on the housing below the worm, an open ended slot extending from one open end of the lower wall in a direction transverse to the axial direction of the headrail and to a position adjacent said worm, a rotatable wormwheel, having an axis of rotation, a bearing surface extending parallel to said axis of rotation, and means permitting said bearing surface to be slidable into said slot along a direction perpendicular to said axis of rotation and along said transverse direction to said position in which said wormwheel is in operable engagement with the worm, and means to retain the wormwheel in this position.

2. A traveller for holding a louvre of a vertical louvre blind in a blind headrail, said traveller comprising a housing, means to guide and support said housing with respect to the blind headrail, a worm rotatable about a horizontal axis so as to be driven by a tilt rod extending longitudinally within the blind headrail, and a wormwheel rotatable about a vertical axis in operable engagement with said worm, wherein the body of the wormwheel has a vertical bore therein, said body comprising an upper and a lower abutment surface facing in opposite directions and further comprising a louvre hook having a shaft insertable into the bore, the shaft having a head thereon, engageable with the upper abutment surface, said head being resiliently deformable to allow the shaft insertion and its own engagement with the upper abutment surface and the hook further having at least one arm engageable with the lower abutment surface of the wormwheel, to urge the hook downwardly and the head against the upper abutment surface.

3. A traveller as claimed in claim 2, wherein the head includes a lower ridge and the upper abutment includes a radially extending groove in which the lower ridge is engageable to give a preferred orientation of the hook relative to the wormwheel, the hook being able to rise against the resilient action of the arm and the ridge and groove being dimensioned to allow relative rotation of the hook and the wormwheel in an overload condition.

4. A vertical louvre blind comprising a headrail, a plurality of substantially identical travellers, means on said travellers to guide the travellers longitudinally in the headrail, a tilt rod rotatable in said headrail and passing through each traveller, a worm in each traveller rotatable by the tilt rod and a wormwheel operably engageable with the worm, a support hook carried by each wormwheel and a louvre mounted on each support hook, a pull cord connected to an end one of said travellers, each traveller being connected to an adjacent traveller by a ball chain, so that, upon operation of the pull cord in one direction, the end traveller may effect translation in one direction, and, in turn, pull the other travellers in said one direction by means of the ball chain, and, upon operation of the pull cord in the opposite direction, the end traveller will move in the opposite direction and push the other carriers with it, each traveller including a housing having a front wall, a pair of forwardly and upwardly extending fingers projecting from said front wall to define a channel thereabove and a first slot therebetween which is open at each end, the lower end of the first slot continuing into a further slot extending at an angle to the first slot and including a restricted end portion at each end, the arrangement being such that (a) the pull cord can pass along and be guided by the channel of each traveller; (b) the pull cord is deflected through the slot of the end traveller and tied into a knot and blocked by the slot to enable the pull cord to effect translation of the end traveller, and (c) a ball chain is passed through the slot and into the further slot and two adjacent balls thereof are engaged against one of said restrictions to connect each traveller to a neighbouring traveller.

5. A travelling tilt rod support for a vertical louvre blind supported from a blind headrail having stop means in said headrail in the path of movement of said support, said tilt rod support comprising a body, means to support and guide the body within the blind headrail, said body comprising a surface for supporting a tilt rod and two resilient members projecting in opposite directions and overlapping at their free ends, said members at their overlap having a mutual distance smaller than the diameter of a pull cord to define means for frictionally clamping said pull cord during free translation of the support and for slidingly guiding said pull cord upon arresting of the support by engagement with said stop means in the headrail.

6. A support as claimed in claim 5, wherein each resilient member has at its free end a projection directed towards the other member.

7. A support as claimed in claim 5 or 6, wherein the support is generally U-shaped, the web of the U forming the support surface for the tilt rod and the resilient members being arranged perpendicular to the web.

8. A support as claimed in claim 5, and further comprising at least one outwardly projecting element on the support, said at least one element being adapted to abut said stop means on the headrail to arrest the support in a predetermined tilt rod supporting position along the headrail.

9. A traveller for holding a louvre of a vertical louvre blind in a blind headrail, said traveller comprising a housing, means to support and guide the housing within the blind headrail, a worm rotatably mounted in said headrail for rotation about a horizontal axis by a tilt rod passing longitudinally through the headrail, a lower wall on the housing below the worm, an open ended slot extending from one open end of the lower wall in a direction transverse to the axial direction of the headrail and to a position adjacent said worm, two flexible side walls extending upwardly from the lower wall and having an opening therein to accommodate a portion of the periphery of a wormwheel in its operable position, said wormwheel having a bearing surface slidable into said slot and along said transverse direction to said position in which said wormwheel is in operable engagement with the worm, said side walls being space by a distance less than the outer dimension of said bearing surface of the wormwheel and being capable of flexing away to allow the wormwheel to slide into said slot and to spring back when said wormwheel is in said operable position to retain it in place.

10. A traveller for holding a louvre of a vertical louvre blind in a blind headrail, said traveller comprising a housing, means to support and guide the housing within the blind headrail, a worm rotatably mounted in said headrail for rotation about a horizontal axis by a tilt rod passing longitudinally through the headrail, a lower wall on the housing below the worm, an open ended slot extending from one open ended slot extending from one open end of the lower wall in a direction transverse to the axial direction of the headrail and to a position adjacent said worm, a wormwheel having a bearing surface slidable into said slot and along said transverse direction to said position in which said wormwheel in in operable engagement with the worm, and means to retain the wormwheel in this position, a front wall of said housing having a pair of forwardly and upwardly extending fingers projecting from said front wall to define a channel thereabove and a first slot therebetween which is open at each end, the lower end of the slot continuing into a second and third slot oppositely directed and each angled with respect to the first slot and having a restricted end portion, the arrangement being such that (a) a pull cord for translating an end traveller can pass along and be guided by the channel; (b) the pull cord can be deflected through the first slot of a traveller and tied into a knot and blocked by the slot to enable the pull cord to effect translation of the traveller, when functioning as an end traveller; (c) a flexible traveller interconnecting means having at least one thicker part can be passed through the first slot into one of said second and third slots, the thicker part thereby engaging from within the innter side of the slot against one of the restrictions to enable the traveller to be connected to a neighboring traveller by the flexible interconnecting means.

* * * * *

UNITED STATES PATENT AND TRADEMARK OFFICE

CERTIFICATE OF CORRECTION

PATENT NO. : 4,648,436

DATED : Mar. 10, 1987

INVENTOR(S) : Herman Oskam

It is certified that error appears in the above-identified patent and that said Letters Patent is hereby corrected as shown below:

ON THE TITLE PAGE: [73] Assignee: line 2

"Curacao, Netherlands" should read --Curacao, Netherlands Antilles--.

Signed and Sealed this

Sixteenth Day of August, 1988

*Attest:*

DONALD J. QUIGG

*Attesting Officer*

*Commissioner of Patents and Trademarks*